US009011106B2

(12) United States Patent
Pal

(10) Patent No.: US 9,011,106 B2
(45) Date of Patent: Apr. 21, 2015

(54) FAN MOTOR CONTROLLER

(75) Inventor: Debabrata Pal, Hoffman Estates, IL (US)

(73) Assignee: Hamilton Sundstrand Corporation, Windsor Locks, CT (US)

( * ) Notice: Subject to any disclaimer, the term of this patent is extended or adjusted under 35 U.S.C. 154(b) by 309 days.

(21) Appl. No.: 13/465,405

(22) Filed: May 7, 2012

(65) Prior Publication Data

US 2013/0294930 A1 Nov. 7, 2013

(51) Int. Cl.

| | |
|---|---|
| ***F04D 25/08*** | (2006.01) |
| ***F04B 49/06*** | (2006.01) |
| ***F04D 19/00*** | (2006.01) |
| ***F04D 25/06*** | (2006.01) |

(52) U.S. Cl.

CPC ..... *F04B 49/06* (2013.01); *F04D 19/002* (2013.01); *F04D 25/068* (2013.01)

(58) Field of Classification Search

CPC ... F04D 25/0606; F04D 25/08; F04D 25/082; F04D 29/5806; F04D 29/5813; F04D 29/522; H02K 5/20; H02K 9/04; H02K 9/06

USPC ..... 417/352, 353, 366, 369, 423.7, 423.8, 417/423.14

See application file for complete search history.

(56) References Cited

U.S. PATENT DOCUMENTS

| | | | | |
|---|---|---|---|---|
| 4,164,690 | A * | 8/1979 | Muller et al. | 318/400.41 |
| 5,205,712 | A | 4/1993 | Hamilton | |
| 6,525,938 | B1 * | 2/2003 | Chen | 361/695 |
| 6,592,400 | B2 * | 7/2003 | Shy et al. | 439/527 |
| 6,841,957 | B2 * | 1/2005 | Brown | 318/400.01 |
| 6,924,979 | B2 * | 8/2005 | Clements et al. | 361/695 |
| 7,188,475 | B2 | 3/2007 | McGinley et al. | |
| 7,719,836 | B2 * | 5/2010 | Franz et al. | 361/695 |
| 7,757,502 | B2 | 7/2010 | Merritt et al. | |
| 7,923,875 | B2 * | 4/2011 | Henry et al. | 310/89 |
| 7,985,056 | B2 * | 7/2011 | Chou et al. | 417/423.14 |
| 8,112,983 | B2 | 2/2012 | Bradbrook | |
| 8,308,451 | B2 * | 11/2012 | Pal | 417/370 |
| 8,324,746 | B2 | 12/2012 | Bradbrook | |
| 8,368,497 | B2 * | 2/2013 | Pal et al. | 336/60 |
| 8,459,966 | B2 | 6/2013 | Hipsky et al. | |
| 8,593,808 | B2 * | 11/2013 | Pal et al. | 361/695 |
| 2008/0124234 | A1 * | 5/2008 | Echazarreta | 417/423.14 |
| 2008/0279694 | A1 * | 11/2008 | Chou et al. | 416/244 R |
| 2009/0226309 | A1 * | 9/2009 | Reuter | 415/182.1 |
| 2012/0014784 | A1 | 1/2012 | Hipsky et al. | |
| 2012/0236498 | A1 | 9/2012 | Pal et al. | |
| 2012/0243177 | A1 | 9/2012 | Pal | |

* cited by examiner

*Primary Examiner* — Peter J Bertheaud

(74) *Attorney, Agent, or Firm* — Carlson, Gaskey & Olds, PC

(57) ABSTRACT

A fan motor controller for a turbine engine comprises a component mounting base and a plurality of fan controller components mounted to the component mounting base. The component mounting base comprises a plurality of sections that are configured to extend circumferentially around a fan inner housing.

23 Claims, 5 Drawing Sheets

FAN MOTOR CONTROLLER

BACKGROUND OF THE INVENTION

This disclosure relates to a fan motor controller that is wrapped around an inner housing structure in a fan section of a fan.

Traditionally, fan motor controller components are mounted within a controller housing that is mounted to an upper surface of a fan housing. The controller housing comprises a large box-shaped structure that is made from a plurality of flat metal panels. Controller components are mounted on inner surfaces of the panels and the panels are fastened to each other with a plurality of fasteners to enclose the components within the box-shaped internal cavity of the housing.

The panels are heavy and costly to manufacture. Further, fan air flow is bled from main fan flow to provide convection cooling to the components inside the controller housing that are not directly cooled by the fan housing. This reduces fan efficiency or pressure rise.

SUMMARY OF THE INVENTION

In one exemplary embodiment, a fan motor controller includes a component mounting base comprised of a plurality of sections that are configured to extend circumferentially around a fan inner housing, and a plurality of fan controller components mounted to the component mounting base. The plurality of fan controller components are configured to control a fan motor.

In a further embodiment of the above, the plurality of sections extends three hundred and sixty degrees about the fan inner housing.

In a further embodiment of any of the above, the plurality of sections comprise a polygonal-shaped portion of an outer surface of the fan inner housing.

In a further embodiment of the above, the polygonal-shaped portion is comprised of six sections configured to form a hexagonal-shaped outer surface of the inner housing.

In a further embodiment of the above, the component mounting base is formed as part of an outer surface of the fan inner housing, and including a fan outer housing located radially outwardly of the fan inner housing, the fan outer housing providing an inner peripheral surface with a metallization interconnect layer that connects to the plurality of fan controller components.

In a further embodiment of the above, the fan outer housing is comprised of a plastic material and the metallization interconnect layer is comprised of a plurality of metal layers that are deposited on the plastic material.

In a further embodiment of the above, at least one controller component of the plurality of controller components is mounted to each section of the plurality of sections, and at least one interconnect member extends between one of the metal layers and each controller component.

In another exemplary embodiment, a fan comprises a fan duct and inner housing defining a central axis, a fan outer housing spaced radially outward of the fan inner housing, and a fan motor configured to draw air into an inlet of the fan duct and inner housing. A fan motor controller is configured to control the fan motor. The fan motor controller includes a mounting base portion comprised of a plurality of sections that are configured to extend circumferentially around at least a portion of the fan inner housing and a plurality of fan controller components mounted to the mounting base portion and surrounded by the fan outer housing.

In a further embodiment of the above, stator vanes extend radially inwardly from the inner housing in a direction toward the central axis. The plurality of sections comprises a polygonal-shaped portion formed as part of an outer surface of the inner housing, and the polygonal shaped portion is radially aligned with the stator vanes.

These and other features of this application will be best understood from the following specification and drawings, the following of which is a brief description.

DETAILED DESCRIPTION

Figure 1:
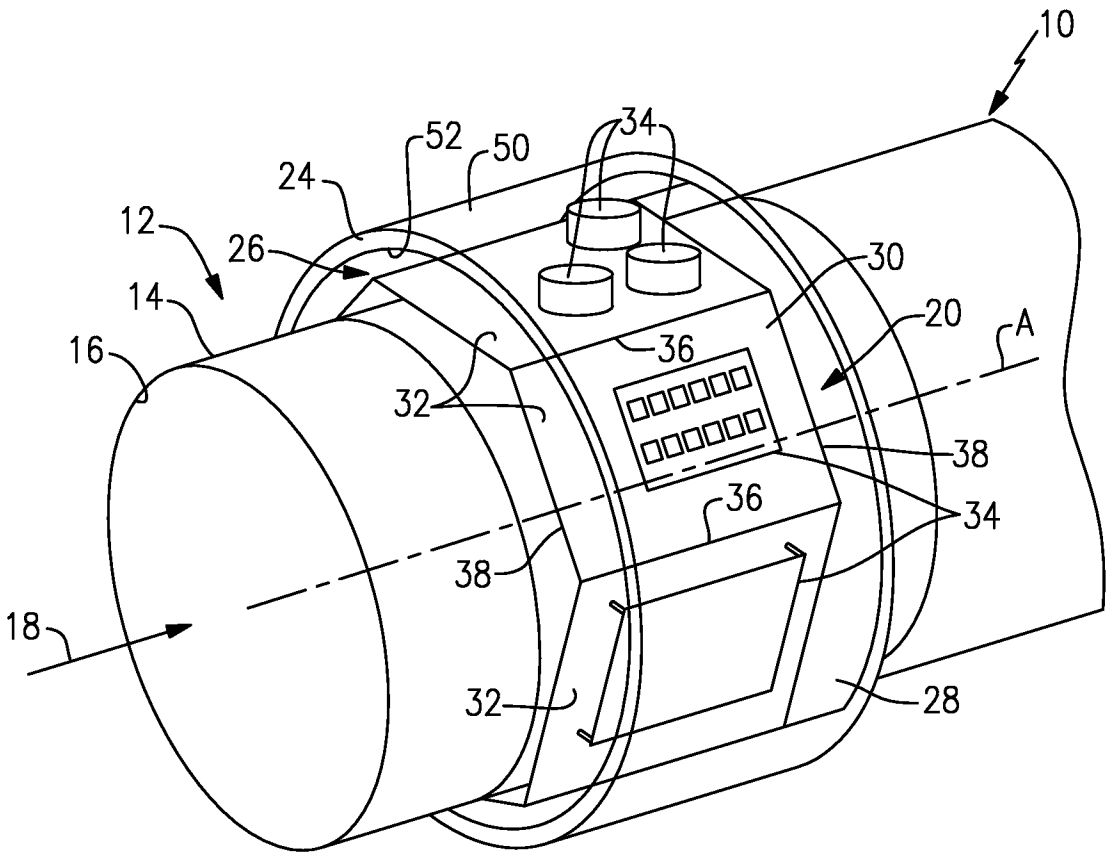
FIG. 1 schematic perspective view of a fan motor controller wrapped around an inner housing.

FIG. 1 schematically illustrates a fan 10 including a fan section 12 comprising a fan duct and inner housing 14 that defines an inlet 16 for fan air flow 18. A fan motor controller 20 is configured to control a fan motor 22 (FIG. 3) to urge or draw additional air flow into the inlet 16 as needed. The fan inner housing 14 defines a fan central axis A. A fan outer housing 24 is spaced radially outward of the inner housing 14 to define an annular space 26 between the inner 14 and outer 24 housings.

The fan motor controller 20 includes a mounting base portion 30 that is comprised of a plurality of sections 32 and a plurality of controller components 34 that are mounted to the mounting base portion 30. The mounting base portion 30 is positioned within the annular space 26 and is formed as part of an outer surface 28 of the inner housing 14. Optionally, the mounting base portion 30 can be a separate mounting component directly attached to the inner housing 14.

Each section 32 of the mounting base portion 30 comprises a generally planar portion defined by a first pair of edges 36 extending in a direction common with the axis A and a second pair of edges 38 that extend circumferentially around the axis A. The sections 32 are connected to each other along the first pair of edges 36 such that the sections 32 form a unitary polygonal shape that extends circumferentially about the inner housing 14. In this example, the sections 32 that form the mounting base portion 30 comprise a unitary structure formed as a single-piece component with the inner housing 14.

In one example, the mounting base portion 30 is configured to extend completely around the inner housing. Thus, the sections 32 are configured to extend three hundred and sixty degrees around the outer surface 28 of inner housing 14.

Figure 2:
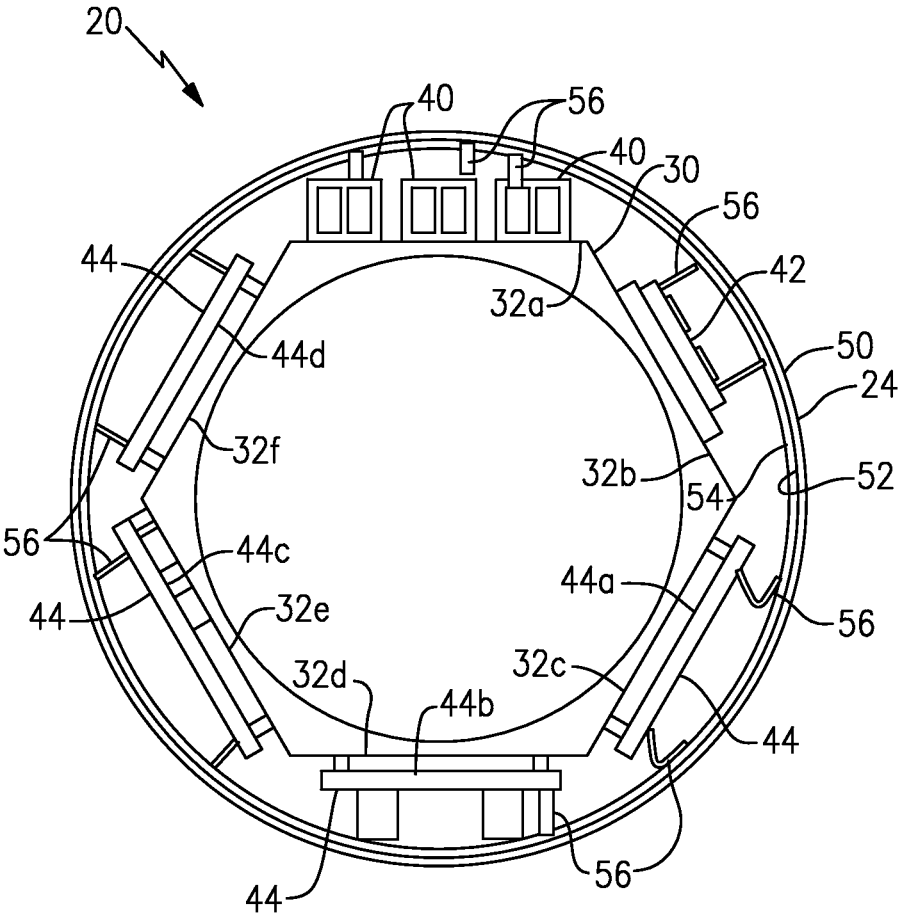
FIG. 2 is an end view of the fan motor controller of FIG. 1.

In one example shown in FIG. 2, the mounting base portion 30 comprises a polygonal-shape with each section 32 forming one side of the associated polygon. In the example of FIG. 2, the polygonal shape comprises a hexagon shape, i.e. the mounting base portion 30 includes six sections 32 that are configured to form a hexagon. This shape is merely one example, and it should be understood that the mounting base portion 30 could be comprised of various polygonal shapes.

The plurality of controller components 34 are mounted to the sections 32 in a desired arrangement. FIG. 2 shows one example of a controller component arrangement. In this example, the plurality of sections comprises a first section 32*a*, a second section 32*b*, a third section 32*c*, a fourth section 32*d*, a fifth section 32*e*, and a sixth section 32*f*. The plurality of controller components 34 include components such as inductors 40, a power module 42, and a plurality of printed wiring boards 44, for example. The plurality of printed wiring boards 44 can include a gate drive printed wiring board 44*a*, a capacitor printed wiring board 44*b*, a control printed wiring board 44*c*, and a filter printed wiring board 44*d*, for example.

One example arrangement has the inductors 40 mounted to the first section 32*a*, the power module 42 mounted to the second section 32*b*, the gate drive printed wiring board 44*a* mounted to the third section 32*c*, the capacitor printed wiring board 44*b* mounted to the fourth section 32*d*, the control printed wiring board 44*c* mounted to the fifth section 32*e*, and the filter printed wiring board 44*d* mounted to the sixth section 32*f*. It should be understood that fewer or additional controller components could also be utilized in any of various arrangements on the sections 32.

Figure 3:
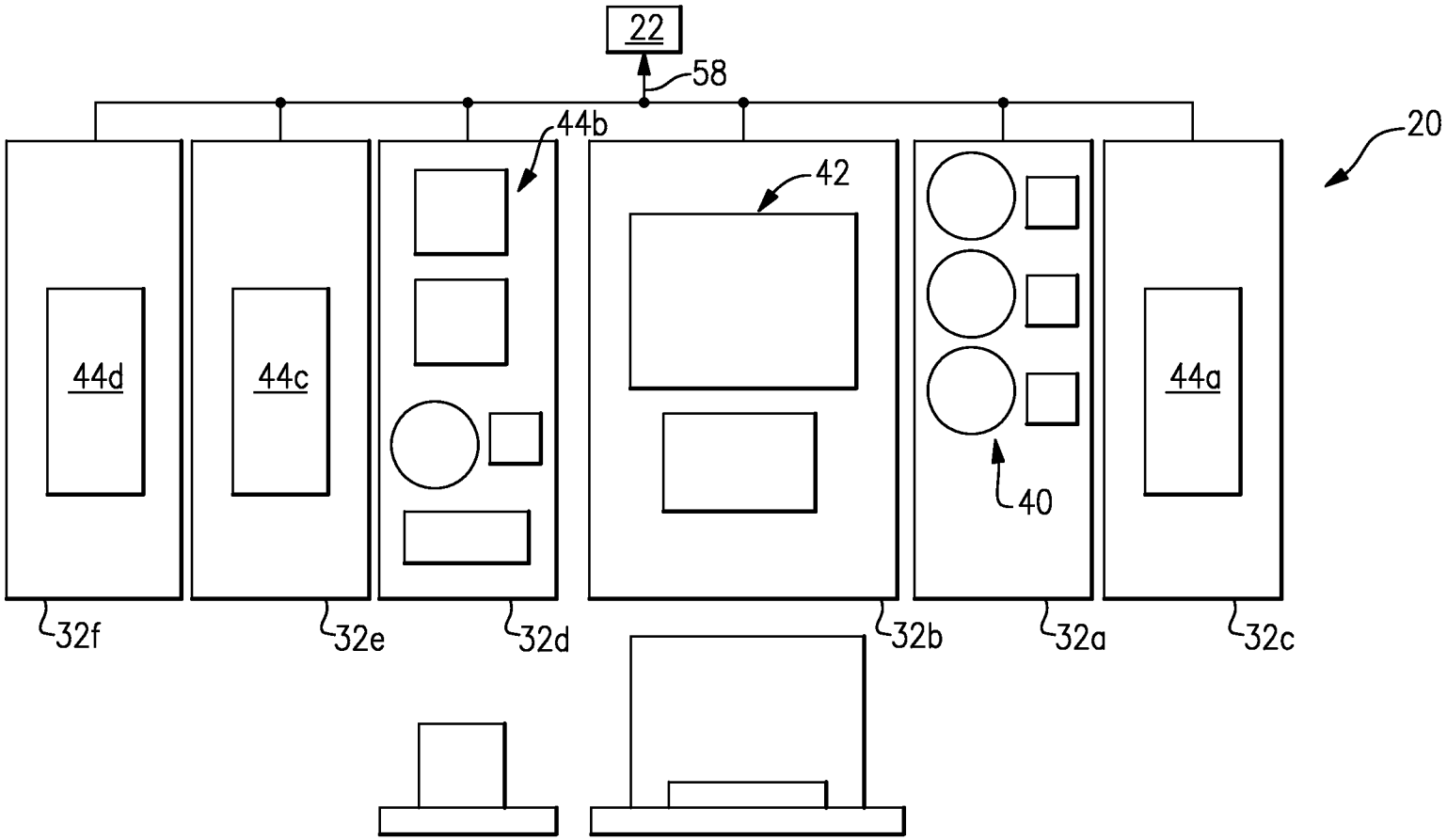
FIG. 3 is an unwrapped view of the fan motor controller of FIG. 2.

FIG. 3 shows a schematic unwrapped version of the mounting base portion 30 with the various sections 32 being unwrapped from surrounding the inner housing 14 and arranged to be flat with the page. Again, these sections 32 can be positioned in various arrangements where the components 34 are connected to each other via the metallization interconnect layer 54 and cooperate to provide an AC power 58 to control the fan motor 22.

As discussed above, the fan outer housing 24 is configured to surround the mounting base portion 30 and the plurality of controller components 34. The fan outer housing 24 includes an outer peripheral surface 50 and an inner peripheral surface 52. A metallization interconnect layer 54 is provided on the inner peripheral surface 52. The metallization interconnect layer 54 serves to connect the various controller components 34 on the multiple sections 32 to each other. A plurality of interconnect members 56 extend between the metallization interconnect layer 54 and the various controller components 34.

Figure 4:
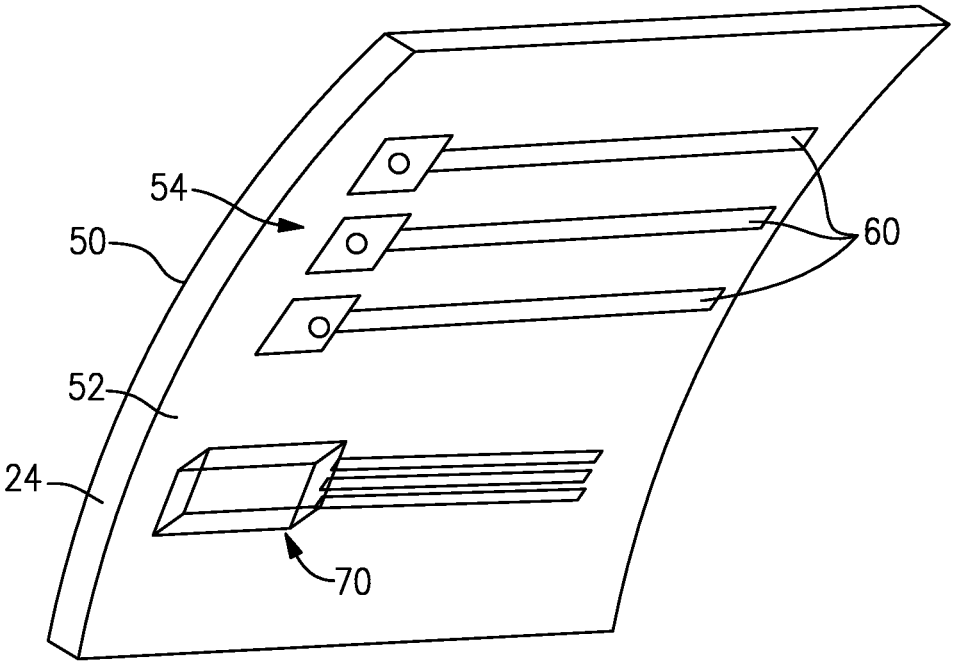
FIG. 4 is a schematic representation of metallization on an inner surface of an outer housing surrounding the fan motor controller.

In one example, the outer housing 24 is comprised of a plastic material. The metallization interconnect layer 54 is comprised of a plurality of metal layers 60 that are deposited on the plastic material as schematically shown in FIG. 4. In one example, the metal layers are comprised of a copper based material; however, other metallic materials could also be used. The interconnect members 56 route power and control signals from the components 34 to the metal layers 60. In addition, high density flux circuits 70 can be used to connect printed wiring boards 44 to each other.

Figure 5:
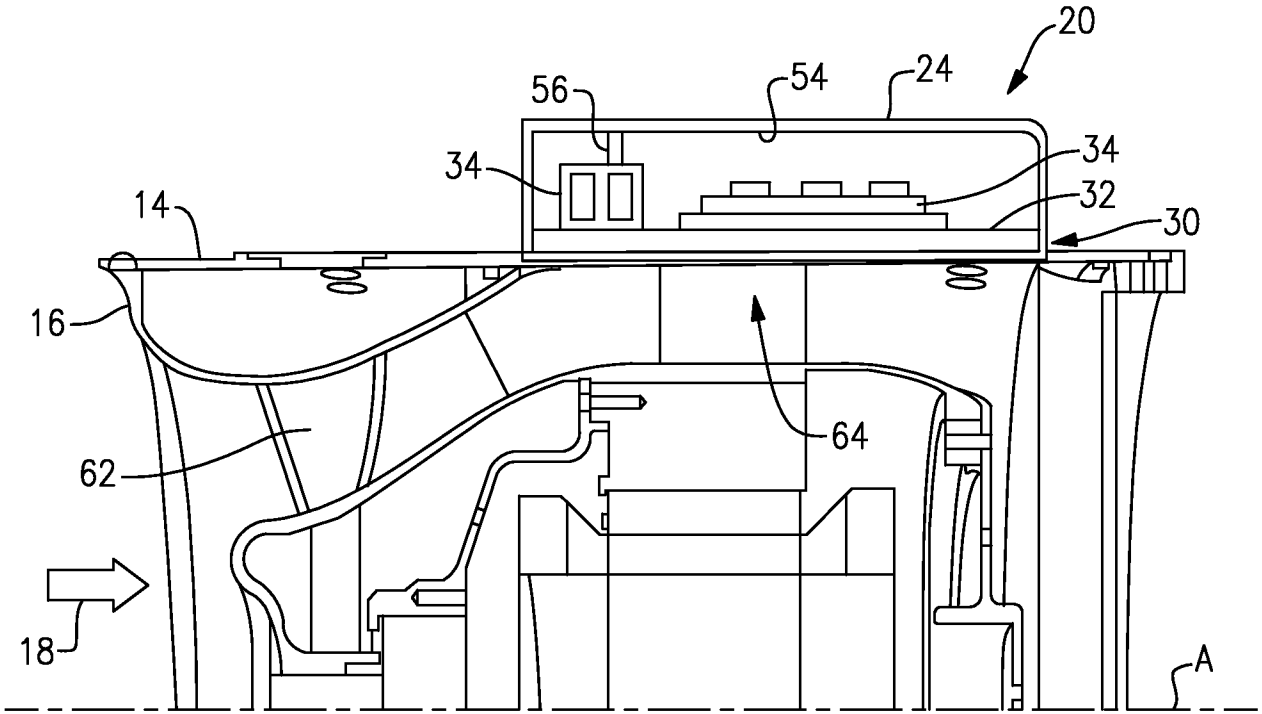
FIG. 5 is a cross-sectional view of a fan section with the fan motor controller of FIG. 1.

FIG. 5 is a partial cross-sectional view of the fan section 12 showing an example mounting position of the fan motor controller 20. The fan duct and inner housing 14 defines the air inlet 16 for fan air flow 18. A plurality of fan blades 62 are positioned adjacent to the inlet 16 and are configured to be driven about the axis A. Stator vanes 64 of the fan section 12 are positioned aft of the blades 62. The outer housing 24 is axially positioned to overlap the stator vanes 64. The controller components 34 are located within the annular space 26 between the inner 14 and outer 24 housings at location that overlaps with the vanes 64, which is beneficial from a cooling aspect. The stator vanes 64 will provide enhancement of heat transfer as they will act as fins.

The fan motor controller 20 mounts controller components 34 to the inner housing 14 via a mounting base portion 30 that is configured to utilize the entire three hundred and sixty degree outer surface of the inner housing 14. The outer surface 28 of the inner housing 14 is formed with a polygonal shape to accomplish the three hundred and sixty degree mounting configuration. The various controller components 34 are mounted to this polygonal section of the inner housing. Heat from these components 34 is conducted directly to the inner housing 14. The interconnect members 56 route power and control signals from these components 34 to the metal layers 60. The fan motor controller 20 is positioned to be radially outwardly located relative to the stator vanes 64 of the fan to improve cooling flow.

The subject fan motor controller 20 provides significant weight reduction compared to traditional configurations due to the plastic outer housing and the compact packaging arrangement extending circumferentially around the inner housing 14. Further, discrete connectors and previously required mother boards are replaced by metalized interconnects that are integrated on the outer housing 24. The printed wiring boards 44 and power components are now mounted on a cooled area of the fan section. Bleed flow previously required for cooling purposes can potentially be eliminated, or at least significantly minimized, resulting in an increase in fan efficiency.

Although an embodiment of this invention has been disclosed, a worker of ordinary skill in this art would recognize that certain modifications would come within the scope of this invention. For that reason, the following claims should be studied to determine the true scope and content of this invention.

The invention claimed is:

1. A fan motor controller comprising:

a component mounting base comprised of a plurality of sections that are configured to extend circumferentially around a fan inner housing, and wherein the component mounting base is formed as part of an outer surface of the fan inner housing;

a fan outer housing located radially outwardly of the fan inner housing; and a plurality of fan controller components separately mounted to at least two different sections of the component mounting base such that the fan controller components are circumferentially spaced apart from each other, the plurality of fan controller components configured to control a fan motor, and wherein the fan outer housing provides an inner peripheral surface with a metallization interconnect layer that connects to the plurality of fan controller components.

2. The fan motor controller according to claim 1, wherein the plurality of sections extend three hundred and sixty degrees about the fan inner housing.

3. The fan motor controller according to claim 1, wherein the plurality of sections comprise a polygonal-shaped portion of an outer surface of the fan inner housing.

4. The fan motor controller according to claim 3, wherein the polygonal-shaped portion is comprised of six sections configured to form a hexagonal-shaped outer surface of the inner housing.

5. The fan motor controller according to claim 1, wherein the fan outer housing is comprised of a plastic material and wherein the metallization interconnect layer is comprised of a plurality of metal layers that are deposited on the plastic material.

6. The fan motor controller according to claim 5, wherein at least one controller component of the plurality of controller components is mounted to each section of the plurality of sections, and including at least one interconnect member that extends between one of the metal layers and each controller component.

7. The fan motor controller according to claim 1, wherein the plurality of sections comprises at least six sections configured to completely surround the fan inner housing.

8. The fan motor controller according to claim 1, wherein the fan inner housing defines a central axis, and including an annular space defined between the inner peripheral surface of the fan outer housing and the outer surface of the fan inner housing to surround the central axis, and wherein the plurality of fan controller components are mounted within the annular space.

9. The fan motor controller according to claim 8, wherein the plurality of fan controller components are mounted within the annular space to at least four different sections of the plurality of sections.

10. The fan motor controller according to claim 5, wherein the interconnect members route power and control signals to the metal layers.

11. A fan motor controller comprising:

a component mounting base comprised of a plurality of sections that are configured to extend circumferentially around a fan inner housing, wherein the plurality of sections comprises at least six sections configured to completely surround the fan inner housing; and a plurality of fan controller components mounted to the component mounting base, the plurality of fan controller components configured to control a fan motor, and wherein the plurality of fan controller components comprises at least inductors, a power module, and a plurality of printed wiring boards that are each mounted to one of the six sections.

12. The fan motor controller according to claim 11, wherein the plurality of printed wiring boards includes at least a gate drive printed wiring board, a capacitor printed wiring board, a control printed wiring board, and a filter printed wiring board.

13. A fan comprising:

a fan duct and inner housing defining a central axis;

a fan outer housing spaced radially outward of the fan inner housing to define an annular space between the inner housing and the fan outer housing;

and a fan motor controller configured to control a fan motor, the fan motor controller including a mounting base portion comprised of a plurality of sections that are configured to extend circumferentially around at least a portion of the fan inner housing and a plurality of fan controller components separately mounted to at least two different sections of the mounting base portion and surrounded by the fan outer housing, and wherein the fan outer housing has an inner peripheral surface with a metallization interconnect layer that connects to the plurality of fan controller components, and wherein the fan outer housing is comprised of a plastic material and wherein the metallization interconnect layer is comprised of a plurality of metal layers that are deposited on the plastic material, and including interconnect members that extend between the metal layers and the fan controller components.

14. The fan according to claim 13, wherein the plurality of sections extend three hundred and sixty degrees about the fan inner housing.

15. The fan according to claim 13, wherein the plurality of sections comprises a polygonal-shaped portion formed as part of an outer surface of the inner housing.

16. The fan according to claim 15, wherein the polygonal-shaped portion is comprised of six sections configured to form a hexagon.

17. The fan according to claim 13, wherein the plurality of fan controller components includes at least inductors, a power module, and a plurality of printed wiring boards.

18. The fan according to claim 17, wherein the plurality of printed wiring boards includes at least a gate drive printed wiring board, a capacitor printed wiring board, a control printed wiring board, and a filter printed wiring board.

19. The fan according to claim 13, including stator vanes extending radially inwardly from the inner housing in a direction toward the central axis, and wherein the plurality of sections comprises a polygonal-shaped portion formed as part of an outer surface of the inner housing, and wherein the polygonal shaped portion is radially aligned with the stator vanes.

20. The fan according to claim 13, wherein the inner housing defines an inlet spaced radially inward of the annular space, and wherein the plurality of fan controller components are located within the annular space between the inner and outer housings.

21. The fan according to claim 13, wherein the interconnect members route power and control signals to the metal layers.

22. The fan according to claim 13, wherein the annular space completely surrounds the central axis, and wherein the plurality of fan controller components are mounted within the annular space to at least four different sections of the plurality of sections.

23. A fan comprising:

a fan duct and inner housing defining a central axis;

a fan outer housing spaced radially outward of the fan inner housing; and a fan motor controller configured to control a fan motor, the fan motor controller including a mounting base portion comprised of a plurality of sections that are configured to extend circumferentially around at least a portion of the fan inner housing, and a plurality of fan controller components mounted to the mounting base portion and surrounded by the fan outer housing, and wherein the plurality of fan controller components includes at least inductors, a power module, and a plurality of printed wiring boards, and wherein the plurality of printed wiring boards includes at least a gate drive printed wiring board, a capacitor printed wiring board, a control printed wiring board, and a filter printed wiring board, and wherein the plurality of sections comprises at least a first section, second section, third section, fourth section, fifth section and sixth section, and wherein the inductors are mounted to the first section, the power module is mounted to the second section, the gate drive printed wiring board is mounted to the third section, the capacitor printed wiring board is mounted to the fourth section, the control printed wiring board is mounted to the fifth section, and the filter printed wiring board is mounted to the sixth section.

* * * * *